US006148589A

United States Patent [19]

Fukui et al.

[11] Patent Number: 6,148,589

[45] Date of Patent: Nov. 21, 2000

[54] METHOD AND APPARATUS FOR PACKAGING GROUP OF CYLINDRICAL ARTICLES

[75] Inventors: Kenji Fukui, Tokyo; Kazuhiro Takahashi, Chiba, both of Japan

[73] Assignee: Omori Machinery Co., Ltd., Saitama, Japan

[21] Appl. No.: 09/407,553

[22] Filed: Sep. 28, 1999

[30] Foreign Application Priority Data

Dec. 4, 1998 [JP] Japan ..... 10-345760

[51] Int. Cl.[7] ..... B65B 53/02

[52] U.S. Cl. ..... 53/442; 53/135.1; 53/375.7; 53/443; 53/450; 53/477; 53/479

[58] Field of Search ..... 53/415, 443, 444, 53/448, 450, 477, 479, 375.9, 373.7, 374.8, 135.1

[56] References Cited

U.S. PATENT DOCUMENTS

| | | | |
|---|---|---|---|
| 3,402,524 | 9/1968 | Griner | 53/550 |
| 4,338,768 | 7/1982 | Ballestrazzi et al. | 209/3.3 |
| 4,924,659 | 5/1990 | Watanabe | 53/555 |
| 5,050,368 | 9/1991 | Noh | 34/218 |

FOREIGN PATENT DOCUMENTS 53-32750 10/1975 Japan .

*Primary Examiner*—Peter Vo
*Assistant Examiner*—Hemant M. Desai
*Attorney, Agent, or Firm*—Dougherty & Associates

[57] ABSTRACT

Disclosed is a method and an apparatus for sorting cylindrical articles such as dry cells and certainly cutting and heat-sealing a cylindrical film of thermal shrinkage resin at a boundary between a film portion enclosing one group and a film portion enclosing the next group in the course of carrying the article groups while keeping each interval between the two adjacent groups. Front side and rear side carrying conveyor belts disposed in front of and behind the upper and lower end sealers in the carrying direction are taken as holding conveyor belts capable of pressing from above the articles. At least one of the holding conveyor belts is movable forwardly and rearwardly relative to the other. A rear end of the front side carrying conveyor belt is positioned behind a front end of the rear holding conveyor belt in the carrying direction in a state in which the upper and lower end sealers are most separated from each other, and both the carrying conveyor belts are moved in the direction in which the carrying conveyor belts are separated from each other as the upper and lower end sealers are gradually moved closer to each other.

6 Claims, 9 Drawing Sheets

METHOD AND APPARATUS FOR PACKAGING GROUP OF CYLINDRICAL ARTICLES

BACKGROUND OF THE INVENTION

The present invention relates to a method and an apparatus for packaging each of groups of cylindrical articles such as dry cells, and particularly to a method and an apparatus for sorting cylindrical articles into groups each being composed of a predetermined number of the articles, carrying the article groups in a thermal shrinkage film formed into a cylindrical shape, and cutting and heat-sealing, in the course of carrying the article groups enclosed in the cylindrical film, a boundary between a film portion enclosing one article group and a film portion enclosing the next article group.

To sort cylindrical articles such as dry cells into groups each being composed of a predetermined number of the cells and package each of the cell groups, there has been generally used a uniaxially oriented film of polyvinyl chloride being good in thermal shrinkage characteristic and transparency.

For example, Japanese Patent Examined (KOKOKU) Publication No. 53-32750 discloses a method and an apparatus in which a film of polyvinyl chloride is rewound from a film roll; during a period in which the film is carried, the film is perforated in the width direction with a predetermined pitch and is formed into a cylindrical shape with one side portion opened by a sleeve forming device; and cylindrical articles such as dry cells grouped into a predetermined number of the cells are fed in the cylindrical film. At this time, it is previously set that each group of the cylindrical articles are fed to an intermediate portion between two perforated line portions adjacent to each other in the longitudinal direction. Next, the opened edges of the opened side portion of the film are sealed in the longitudinal direction to form the film into the cylindrical shape, and then the cylindrical film is preliminarily shrunk by blasting hot-air thereto. During a period in which the preliminarily shrunk sleeve-shaped film is carried on a horizontal conveyor while being held from above and below, such a film is transferred on a slope conveyor running at a speed higher than that of the horizontal conveyor. In such transfer, the above perforated line portion is cut because the film is stretched by a difference in speed between the horizontal conveyor and the slope conveyor. After that, the packages thus separated from each other are allowed to pass through a shrink tunnel, to secondarily, perfectly shrink the film. In this way, packaged products are obtained.

In the above packaging method, even if the package has passed through the shrink tunnel, both the end portions of the package in the longitudinal direction are not perfectly sealed. If dry cells thus packaged are on display in a shopwindow for a long period of time, dust is liable to be stuck on the opened end of the dry cell package, thereby degrading the external appearance of the dry cell package.

The above-described method is suitable for packaging articles using a uniaxially oriented film of polyvinyl chloride being good in thermal shrinkage characteristic; however, it is unsuitable for packaging articles using a biaxially oriented film of low-pollution polyethylene. Since polyethylene is lower in thermal shrinkage coefficient than polyvinyl chloride and is also quite different in thermal shrinkage condition from polyvinyl chloride, a desirable packaging state cannot be obtained by using a polyethylene film if the cutting dimension of the polyethylene film is equal to that of a polyvinyl chloride film.

SUMMARY OF THE INVENTION

An object of the present invention is to provide a method and an apparatus for sequentially carrying cylindrical articles such as dry cells while sorting the articles into groups each being a predetermined number of the articles, and fusing and cutting, in the course of carrying the article groups while keeping each interval between the two adjacent groups and certainly preventing rolling and positional deviation of the articles; a cylindrical thermal shrinkage film at a boundary between a film portion enclosing one article group and a film portion enclosing the next article group.

Another object of the present invention is to provide a method and an apparatus for packaging groups each being composed of a plurality of cylindrical articles such as dry cells using a biaxially oriented film.

To achieve the above and other objects, according to one aspect of the present invention, there is provided a method of packaging groups of cylindrical articles, including the steps of: carrying cylindrical articles such as dry cells while sorting the articles into groups each being composed of a predetermined number of the articles; inserting the article groups in a thermal shrinkage film formed into a cylindrical shape; and heat-sealing, in the course of carrying the article groups enclosed in the film, a boundary between one film portion enclosing one of the article groups and a film portion enclosing the next of the article groups by upper and lower end sealers; wherein the step of heat-sealing the film includes the steps of: preparing front side and rear side holding conveyor belts for pressing from above the articles, which conveyor belts are provided on front side and rear side carrying conveyor means disposed in front of and behind the upper and lower end sealers in the carrying direction, respectively, wherein at least one of the holding conveyor belts is movable forwardly and rearwardly relative to the other; and positioning a rear end of the front side holding conveyor belt behind a front end of the rear holding conveyor belt in the carrying direction in a state in which the upper and lower end sealers are most separated from each other, and moving the holding conveyor belts in the direction in which the holding conveyor belts are separated from each other as the upper and lower end sealers are gradually moved closer to each other.

The cylindrical articles may be typically a plurality of dry cells.

With this configuration, since the cylindrical articles liable to be rolled are pressed from above and below by the rear side and front side holding conveyor belts directly before the end sealers during a period in which the articles are moved from the front side carrying conveyor means in front of the end sealers and the rear side carrying conveyor means behind the end sealers in the carrying direction, it is possible to prevent occurrence of rolling of the cylindrical articles in the cylindrical film, and hence to certainly perform the end sealing.

The above method preferably includes the step of thermally shrinking only such portions as facing to end surfaces of the articles, of the thermal shrinkage film enclosing the articles before the step of heat-sealing a portion of the film by the upper and lower end sealers.

With this configuration, it is possible to more certainly prevent the cylindrical articles from being rolled in the film upon end sealing.

In the above method, preferably, the step of carrying and sorting the articles includes the step of: carrying the articles along a carrying path at a predetermined speed while sorting the articles into the groups by means of a number of guide pins which are capable of protrusion into and retreat from the articles in the direction perpendicular to the carrying path and which are moved at a speed equal to the carrying speed of the articles; and the step of inserting the article groups in the film includes step of inserting the guide pins together with the articles in a film which is formed into a cylindrical shape with its side portion on the guide pin side opened and carried at a speed equal to the carrying speed, and then pulling the guide pins out of the film.

With this configuration, since each article group is carried in a state being held between the guide pins for some time after being inserted in the cylindrical film, it is possible to certainly prevent occurrence of rolling and positional deviation of the cylindrical articles.

Preferably, the above method may further include the step of: feeding a sheet material such as a pasteboard on the upper surfaces of each of the article groups, and carrying the sheet materials together with the article groups in the film in the course of carrying the article groups along the carrying path while holding the article groups with the guide pins.

With this configuration, since the cell groups are carried without occurrence of rolling and positional deviation, the sheet material placed on the cell groups can be carried in the packaging film without occurrence of positional deviation.

To achieve the above and other objects, according to another aspect of the present invention, there is provided an apparatus for packaging groups of cylindrical, articles including: a means for carrying cylindrical articles such as dry cells while sorting the cylindrical articles into groups each being composed of a predetermined number of the articles, and carrying the cylindrical articles thus grouped in a thermal shrinkage film formed into a cylindrical shape by a sleeve forming device; upper and lower end sealers for heat-sealing a boundary between a film portion enclosing one of the article groups and a film portion enclosing the next of the article groups in the course of carrying the article groups enclosed in the film; a rear side carrying conveyor means provided behind the upper and lower end sealers in the carrying direction, and a front side carrying conveyor means provided in front of the upper and lower end sealers in the carrying direction; and an interlocking means for allowing the rear side and front side carrying conveyor means to be moved apart from each other as the upper and lower end sealers are gradually moved closer to each other, and also allowing the rear side and front side carrying conveyor means to be moved closer to each other as the upper and lower end sealers are moved apart from each other; wherein rear side and front side holding conveyor belts for pressing from above the articles are provided on the rear side and front side carrying conveyor means, respectively; and end portions of the rear side and front side holding conveyor belts are positioned within such different vertical planes as to avoid interference between the end portions in the moving directions thereof, so that a rear end of the front side holding conveyor belt is positioned behind a front end of the rear side holding conveyor belt in the carrying direction when the upper and lower end sealers are most separated from each other.

Again, the cylindrical articles may be typically a plurality of dry cells.

With this configuration, it is possible to certainly carry out the above-described method with a relatively simpler structure.

The above apparatus preferably further includes a means for sealing the cylindrical film in the longitudinal direction, which means is provided behind the upper and lower end sealers in the carrying direction; and a heating means for thermally shrinking such portions as facing to end surfaces of the cylindrical articles, of the cylindrical film from outside of the film, which means is provided between the end sealers and the longitudinally sealing means.

The provision of such a simple heating means makes it possible to prevent occurrence of rolling of the cylindrical articles in the cylindrical film directly before end sealing and hence to certainly perform the end sealing.

The above apparatus preferably further includes a carrying means for carrying the cylindrical articles while sorting the articles into the groups on a carrying path communicated to the sleeve forming device; a first vacuum conveyor running in parallel to the carrying path, which conveyor is provided over the carrying path; a second vacuum conveyor disposed such that a rear end portion thereof covers the first vacuum conveyor and a front end portion thereof is tilted to be joined to the carrying path; a holding conveyor belt disposed in proximity to a front end of the second vacuum conveyor; and a means for feeding pasteboards on the first vacuum conveyor with a predetermined timing; wherein each of the pasteboards fed by the feeding means onto the first vacuum conveyor is fed on the upper surfaces of one of the article groups by the second vacuum conveyor, and is carried while being pressed on the upper surfaces of the article group by the holding conveyor belt.

With this configuration, it is possible to accurately feed a pasteboard with a trade mark or the like on each of the groups of the cylindrical articles, and hence to certainly prevent peeling of the pasteboard in the course of carrying the pasteboard together with the article group.

The above apparatus preferably further includes a thermal shrinking conveyor including a shrink tunnel, which conveyor is provided in front of the front side conveyor belt provided in front of the upper and lower end sealers in the carrying direction; wherein the front side conveyor belt includes a lower side endless conveyor belt; a front end of the endless conveyor belt is wound around a small pulley to be turned back, being wound in an S-shape around a movable pulley on the rear lower side seen from the small pulley and around a fixed pulley on the front lower side seen from the movable pulley; and the small pulley and the movable pulley are mounted on a sliding block supported in such a manner as to be slidably moved forwardly and rearwardly, and the sliding block is joined to a piston rod of a cylinder fixed on a frame; whereby when the piston rod is extended, the small pulley is located at the forefront being in proximity to the thermal shrinking conveyor and when the piston rod is contracted, the small pulley is retreated from the forefront, to drop and eject a defective package at a position being in proximity to the thermal shrinking conveyor.

With this configuration, it is possible to easily eject a defective package at a position directly before the shrink tunnel by extension and contraction of the endless conveyor belt of the front side conveyor belt.

BRIEF DESCRIPTION OF THE DRAWINGS

FIGS. 1 and 2 are views showing a configuration of the entire apparatus of the present invention, wherein FIG. 1 is a front view of the apparatus and FIG. 2 is a plan view of the apparatus;

FIGS. 10*a* and 10*b* are front views showing an essential portion of the front side and rear side carrying conveyor means, wherein FIG. 10*a* shows a state in which the front side and rear side carrying conveyor means are closest to each other, and FIG. 10*b* shows a state in which the front side and rear side carrying conveyor means are most separated from each other.

DETAILED DESCRIPTION OF THE PREFERRED EMBODIMENTS

Hereinafter, there will be described a preferred embodiment of a method and an apparatus for continuously carrying AA dry cells, and sorting the cells, in the course of carrying them, into groups each being composed of an appropriate number, six pieces in this embodiment, of the cells and packaging each of the groups of the cells. It should be noted that in the following description, the terms "front side" and "rear side", are based on the carrying direction of the dry cells.

Figure 1:
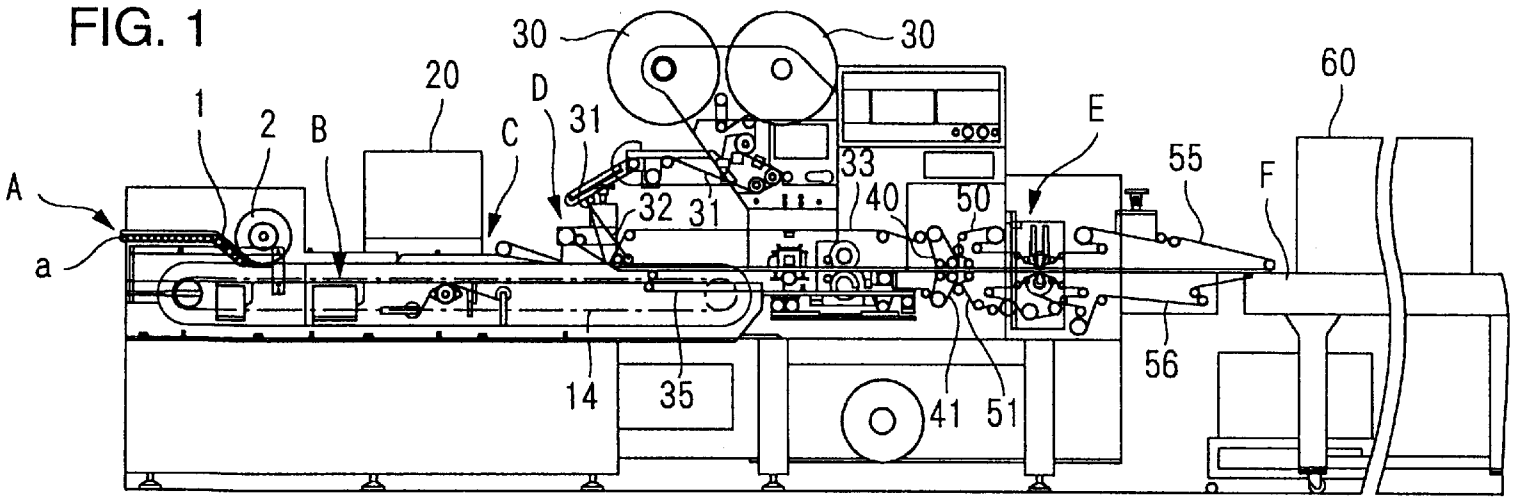
Figure 2:
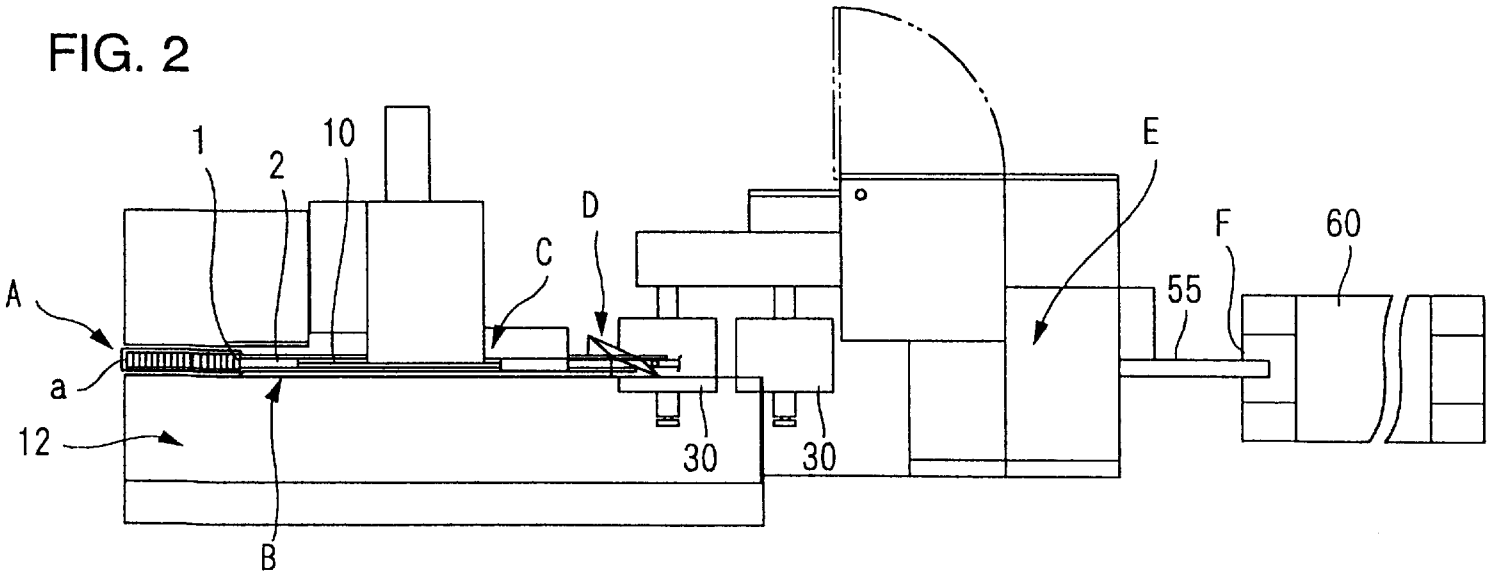

FIGS. 1 and 2 show the entire configuration of an apparatus of the present invention, wherein FIG. 1 is a front view of the apparatus and FIG. 2 is a plan view of the apparatus. First, the entire configuration of the apparatus will be schematically described. An automatic feeding unit A for automatically feeding dry cells "a" is provided on the upper left side of FIG. 1. A carrying unit B for sorting the dry cells "a" into groups each being composed of a predetermined number, six pieces in this embodiment, of the cells and carrying each group of the cells is provided on the upstream side from the automatic feeding unit A in the carrying direction. A pasteboard feeding unit C for feeding one pasteboard from above to each group of six pieces of the dry cells continuously carried by a belt conveyor is disposed over the carrying unit B. A sleeve forming unit D for making a thermal shrinkage packaging film into a sleeve is provided on the upstream side from the pasteboard feeding unit C. A side sealing unit for continuously sealing an opened side portion of the sleeve-shaped film in the longitudinal direction and an end sealing unit E for sealing a boundary between a film portion enclosing one cell group and a film portion enclosing the next cell group are provided on the upstream side from the sleeve forming unit D. A carrying conveyor F including a shrink tunnel for thermally shrinking each bag-shaped film portion enclosing the associated cell group, which has been separated from the next cell group by the end sealing unit E, is provided on the right side of FIGS. 1 and 2.

Each of the above units of the apparatus of the present invention will be described in detail below.

In the automatic feeding unit A for automatically feeding the dry cells "a"a, the dry cells "a" are fed forwardly in a state in which cylindrical side surfaces thereof are in contact with each other, and are dropped through a tilting chute 1. A star wheel type separating unit 2 is disposed in proximity to the chute 1. The separating unit 2 is adapted to control the carrying speed of the dry cells at an appropriate value and to place them on a belt conveyor 10 (see FIG. 2) of the carrying unit B in parallel to each other.

A guide pin feeding unit 12 is juxtaposed to the outer side of the belt conveyor 10 of the carrying unit B. A number of rod-shaped guide pins 13 (see FIGS. 3 and 4), each having a diameter slightly smaller than that of the dry cell, are provided in parallel on the guide pin feeding unit 12. The guide pins 13 are configured to run at a speed equal to that of the dry cells running on the belt conveyor 10. The carrying unit B in combination with the guide pin feeding unit 12 has been described in detail in the earlier application by the present applicant, Japanese Patent Application No. 10-295028, and therefore, the explanation of the detailed configuration is omitted and only part of the configuration necessary for understanding the present invention will be described.

In the guide pin feeding unit 12, a number of the guide pins 13 can be freely protruded/retreated in the direction perpendicular to the carrying path of the belt conveyor 10 while being guided by support block pieces (not shown) mounted to an endless chain 14 shown in FIG. 1. To be more specific, the guide pins 13 are protruded into the carrying path of the belt conveyor 10 behind the star wheel type separating unit 2 in the carrying direction at predetermined intervals (each interval being equivalent to the total length of one group of the six dry cells in the carrying direction in this embodiment), and when the guide pins 13 pass under the star wheel type separating unit 2, six pieces of the dry cells are supplied between the two adjacent ones of the guide pins 13. These two adjacent guide pins 13 are moved together with the dry cell group sandwiched between the guide pins 13 until they carry the associated dry cell group in the sleeve-shaped film formed by the sleeve forming unit D and are pulled out of the film in the direction perpendicular to the carrying direction. At this time, the moving speed of the guide pins 13 is equal to both the carrying speed of the belt conveyor 10 and the moving speed of the packaging film, so that the dry cells are carried without occurrence of rolling and/or positional deviation.

Figure 3:
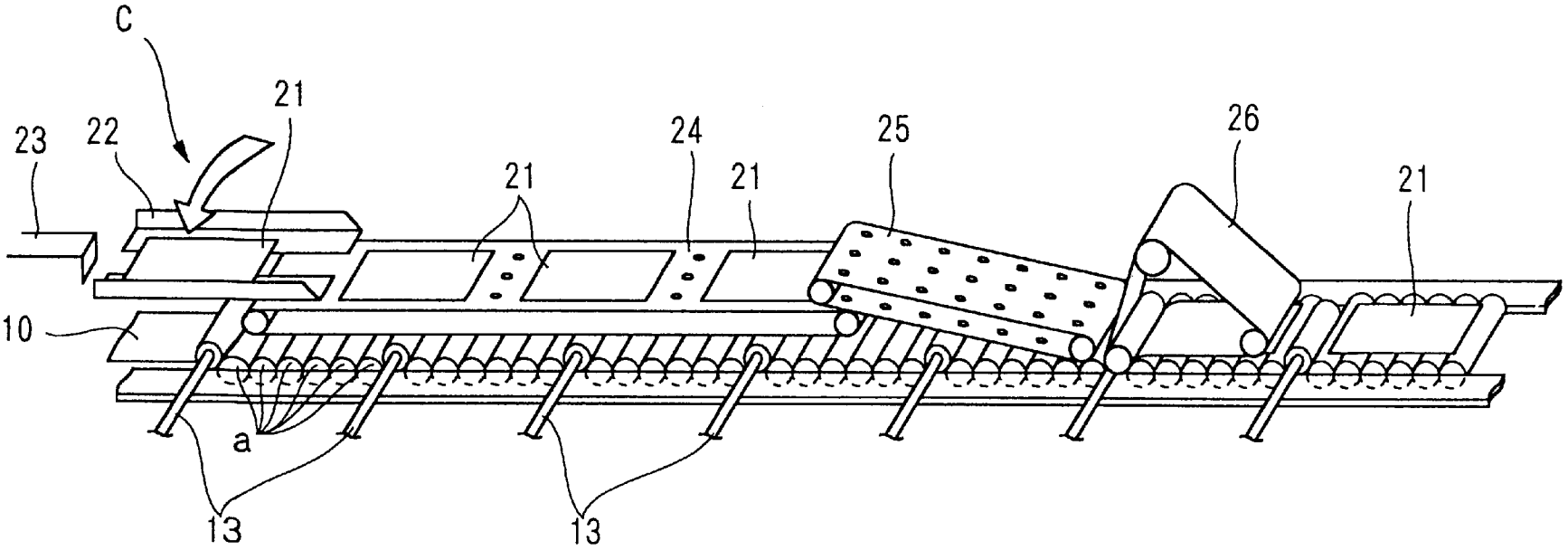
FIG. 3 is a perspective view showing a pasteboard feeding unit of the apparatus of the present invention.

The pasteboard feeding unit C is provided on the front upper side seen from the carrying unit B in such a manner as to be opposed to the guide pin feeding unit 12 with the belt conveyor 10 put therebetween. The pasteboard is a cardboard indicating the trade mark and design of the dry cell, instructions for its use, and the like. In FIG. 1, reference numeral 20 designates a known discharging unit for stocking a number of the pasteboards 21 and attracting and discharging them on a one-by-one basis. As shown in FIG. 3, a pasteboard feeding guide frame 22 is provided over the belt conveyor 10 in such a manner as to be adjacent to the discharging unit 20. The guide frame 22 is composed of a pair of right and left frame portions each of which is L-shaped in cross-section. The frame portions of the guide frame 22 are separated from each other, and at the leading end of the guide frame 22, the width of the guide frame 22, that is, the distance between the right and left frame portions is made narrower to a value equal to the width of the pasteboard. A pusher 23 is provided in such a manner as to be reciprocatingly movable in a space between the right and left frame portions of the guide frame 22 in the range from the rear end to the front end of the guide frame 22. A first vacuum conveyor 24 having in its surface portion a number of small holes is horizontally disposed on the front lower side seen from the guide frame 22. A second vacuum conveyor 25 having in its surface portion a number of small holes is provided such that the rear end portion thereof is tilted to cover the front end portion of the first vacuum conveyor 24. The front end portion of the second vacuum conveyor 25 is disposed in proximity to the upper surfaces of the group of the dry cell "a" moving on the belt conveyor 10 positioned under the second vacuum conveyor 25. A first upper holding conveyor belt 26 for pressingly mounting one pasteboard 21 on the upper surfaces of each group of the dry cells "a" is disposed in front of and in proximity to the second vacuum conveyor 25. The carrying speeds of the first and second vacuum conveyors 24 and 25 and the first upper holding conveyor belt 26 are set to be equal to the moving speed of the dry cells running on the belt conveyor 10 positioned thereunder. It should be noted that each of the first and second vacuum conveyors 24 and 25 is of course communicated to a vacuum source (not shown).

The pasteboards are sequentially fed from the pasteboard discharging unit 20 onto the pasteboard feeding guide frame 22, and are pushed onto the first vacuum conveyor 24 with a predetermined timing by the pusher 23. The above timing is determined such that an interval between two adjacent ones of the pasteboards fed on the first vacuum conveyor 24 becomes equal to an interval between two adjacent ones of the groups of the dry cells. After being fed from above onto the first vacuum conveyor 24, the pasteboards 21 are attracted on the first vacuum conveyor 24 and are carried to the second vacuum conveyor 25.

Since the rear end portion of the second vacuum conveyor 25 covers the front end portion of the first vacuum conveyor 24 in contact therewith, each pasteboard 21 having been carried to the front end portion of the first vacuum conveyor 24 is moved along the bottom surface of the second vacuum conveyor 25 and is simultaneously attracted by the second vacuum conveyor 25. Then, the pasteboard 21 is gradually, obliquely moved to the upper surfaces of the dry cells "a" along with the movement of the second vacuum conveyor 25. When the pasteboard 21 reaches the front end of the second vacuum conveyor 25, the front end portion of the pasteboard 21 is brought in contact with the upper surfaces of the dry cells "a" and is then placed on the upper surfaces of the cells. At this time, the first upper holding conveyor belt 26 holds the front end of the pasteboard 21 and mounts the pasteboard 21 at a central portion of the group of the six cells while holding it between the dry cells positioned under the pasteboard 21 and the same. In such a state, the first upper holding conveyor 26 carries the pasteboard 21 forwardly while holding it. It should be noted that the pasteboard feeding time upon feeding the pasteboard 21 by the discharging unit 20 is previously set such that the pasteboard 21 is mounted on the central portion of the cell group.

The pasteboards 21, which have been discharged from the discharging unit 20 onto the first vacuum conveyor 24 with the predetermined timing, are mounted at the central portions of the upper surfaces of respective dry cell groups at the pre-determined intervals, and are fed together with the dry cells to the sleeve forming unit D while being held between the first upper holding conveyor belt 26 and the dry cells. At this time, since the carrying speeds of the first and second vacuum conveyors 24 and 25, the first upper holding conveyor belt 26, the carrying conveyor belt 10, and the guide pins 13 are set to be all equal to each other, it is possible to prevent occurrence of rolling of the dry cells "a" and positional deviation of the pasteboards mounted thereon during carrying of the pasteboards.

Figure 4:
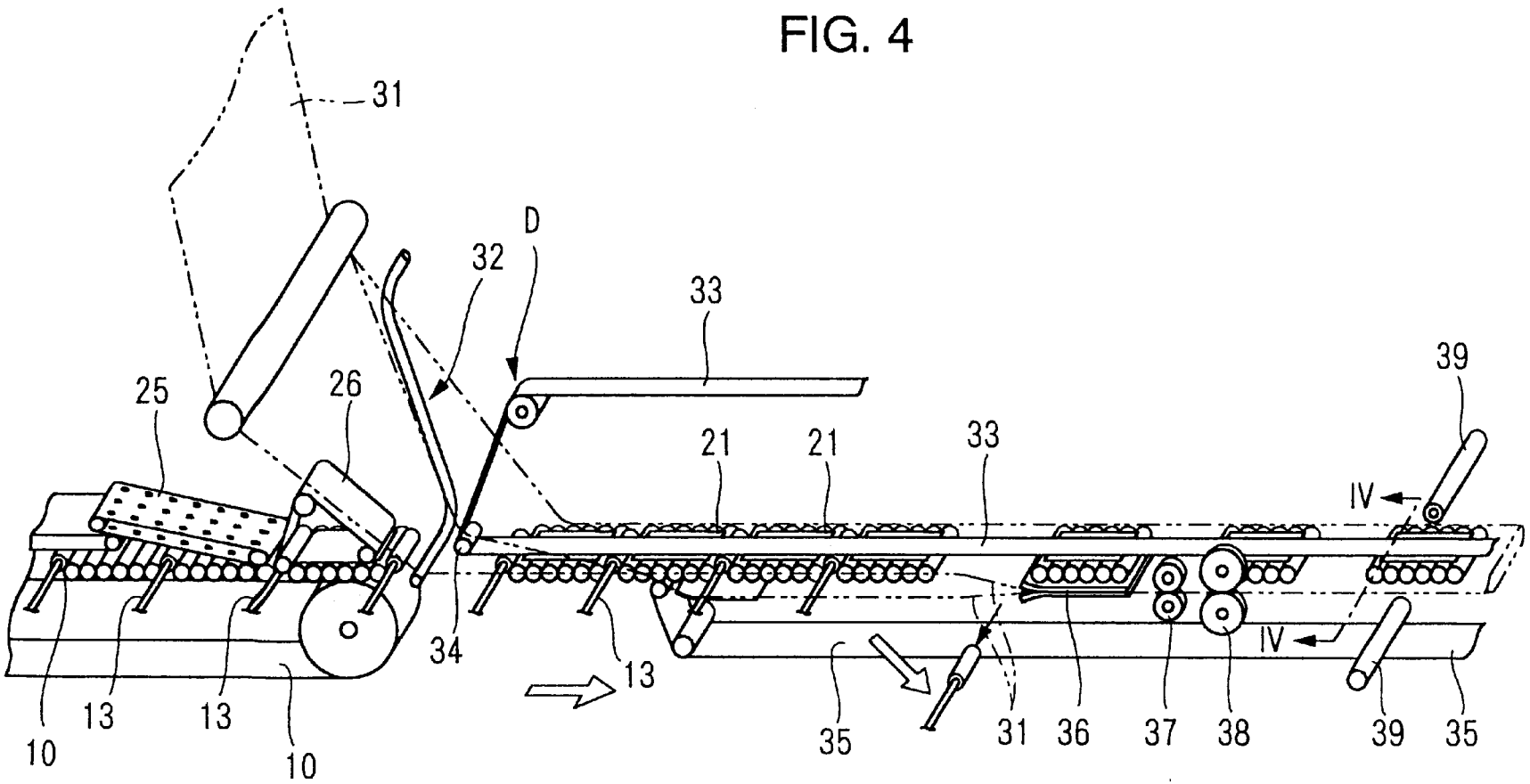
FIG. 4 is a perspective view showing a sleeve forming unit and a side sealing unit of the apparatus of the present invention.

In the sleeve forming unit D, a packaging film 31 rewound from a film roll 30 (see FIG. 1) is fed to a known sleeve forming device 32. At the sleeve forming device 32, as shown in FIG. 4, the film 31 is formed into a cylindrical shape with a side surface on the guide pin feeding unit side (on this side in FIG. 4) being opened for three-sided, seal packaging. A second upper holding conveyor belt 33 for holding the film 31 formed into the cylindrical shape from above onto the dry cell groups is provided in front of and adjacently to the sleeve forming device 32. The second upper holding conveyor belt 33 is driven at a speed equal to the carrying speeds of the cylindrical film and the dry cells. A rear side pulley 34 is provided around which the second upper holding conveyor belt 33 is wound, and a first lower holding conveyor belt 35 driven at a speed equal to that of the second upper holding conveyor belt 33 is provided on the front lower side seen from the rear side pulley 34.

The front end of the belt conveyor 10 of the carrying unit B is terminated in the vicinity of the rear side of the sleeve forming device 32. The groups of the dry cells "a" having been mounted on and carried by the belt conveyor belt 10 are fed in the film 31 formed into the cylindrical shape with one side opened by the sleeve forming device 32 while being held between the guide pins 13. The dry cell groups thus inserted in the cylindrical film 31 are then carried forwardly in a state in which the upper and lower surfaces thereof are held between the second upper holding conveyor belt 33 and the first lower holding conveyor belt 35. The carrying speeds of the packaging film 31, the upper and lower holding conveyor belts 33 and 35 and the guide pins 13 are set to be all equal to each other.

When the dry cells groups start to be carried while being held by the upper and lower holding conveyor belts 33 and 35, the guide pins 13 are pulled out of the dry cell groups. To be more specific, the guide pins 13 are pulled out of the dry cells when they come closer to the front end portion of the endless chain 14 for running the guide pins 13. After that, the dry cells are carried in a state in which each cell group is separated from the next cell group by a gap nearly equal to the diameter of the guide pin, that is, nearly equal to the diameter of the dry cell.

In this embodiment, the guide pin 13 is formed into the cylindrical shape having the circular cross-section nearly equal to that of the dry cell; however, it may be formed into an elliptic or flat shape. Specifically, in the case where the gap between the two adjacent cell groups is changed depending on the kind of the packaging film including difference in thermal shrinkage coefficients, the cross-sectional shape of the guide pin may be changed to keep up with such a change in the gap between the two adjacent cell groups.

Figure 5:
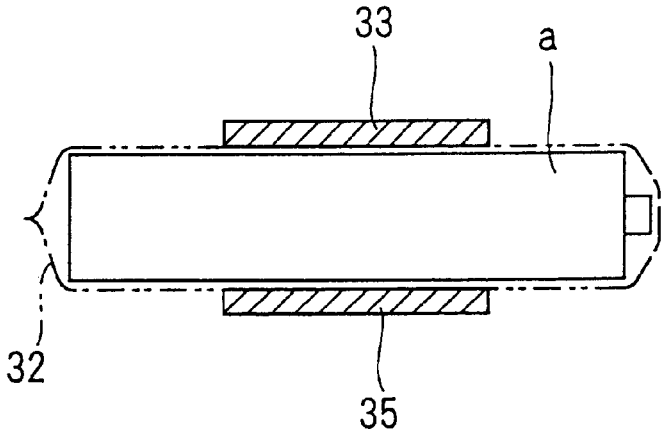
FIG. 5 is a sectional view taken on line IV—IV of FIG. 4.

In front of and in proximity to the pull-out positions of the guide pins 13, guide rails 36 for overlapping the opened edges of the opened side portion of the cylindrical film to each other, a fusing roller 37 for heat-sealing the overlapped edges of the film, and a cutter 38 for trimming the fused portion of the film, are sequentially arranged in such a manner as to face to the opened side portion of the cylindrical film. In this way, as shown in FIG. 5, the dry cell groups are carried in a state being enclosed in the cylindrical film whose both side portions are closed.

Right and left hot-air blasting nozzles 39 are provided in front of the cutter 38 at positions opposed to positive electrode end surfaces and negative electrode end surfaces of the dry cell groups carried forwardly. When each dry cell group passes between the right and left hot-air blasting nozzles 39, film portions opposed to the positive electrode end surfaces and the negative electrode end surfaces of the dry cell group are shrunk to be brought into tight-contact therewith and also film portions between the end surfaces are shrunk. Accordingly, after passing between the nozzles 39, the movement of the dry cells enclosed in the cylindrical film is restricted.

Figure 6:
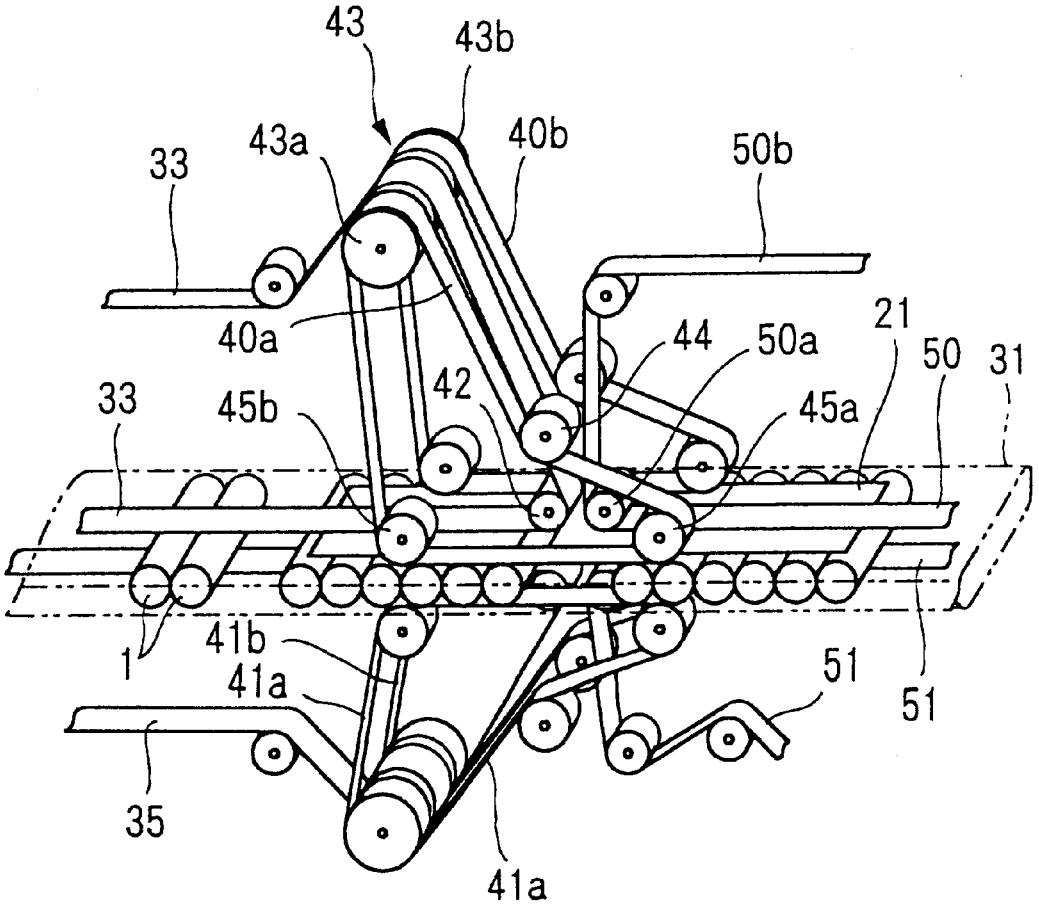
FIG. 6 is a perspective view showing a rear end portion of a rear side carrying conveyor means disposed behind an end sealing unit of the apparatus of the present invention.

As shown in FIG. 6, third upper holding conveyor belts 40*a* and 40*b* and second lower holding conveyor belts 41*a* and 41*b* are disposed at the front end portions of the second upper holding conveyor belt 33 and the first lower holding conveyor belt 35 in such a manner as to hold the second upper holding conveyor belt 33 and the first lower holding conveyor belt 35, respectively.

To be more specific, the front end of the second upper holding conveyor belt 33 runs forwardly along the carrying path, and is wound around a first small pulley 42 disposed in proximity to the upper surface of the carrying path for the dry cell groups and is then wound around a first large pulley 43 on the rear upper side seen from the small pulley 42. The third upper holding conveyor belts 40*a* and 40*b* are wound in a loop shape around large pulleys 43*a* and 43*b* mounted on the same shaft as that of the first large pulley 43 with the first large pulley 43 put therebetween, and around front side second small pulleys 45*a* and rear side third small pulleys 45*b* disposed in proximity to the upper surface of the carrying path for the dry cell groups. Guide pulleys 44 for rearwardly bending the third upper holding conveyor belts 40*a* and 40*b* are provided between the large pulleys 43*a* and 43*b* and the front side second small pulleys 45*a*. The front side second small pulleys 45*a* are positioned in front of the first small pulley 42. In addition, the second lower holding conveyor belts 41*a* and 41*b* are disposed in such a manner as to be substantially symmetric to the third upper holding conveyor belts 40*a* and 40*b* with respect to the carrying path for the dry cell groups, respectively. The carrying speeds of the third upper holding conveyor belts 40*a* and 40*b* and the second lower holding conveyor belts 41*a* and 41*b* are of course set to be equal to the carrying speed of the packaging film.

A conveyor means of the end sealing unit E is provided in front of the upper holding conveyor belts 33, 40*a* and 40*b* and the lower holding conveyor belts 35, 41*a* and 41*b*. The conveyor means of the end sealing unit E is divided into a front side conveyor means and a rear side conveyor means with respect to a pair of upper and lower end sealers 52 and 53 for heat-sealing the cylindrical film containing the dry cell groups in the direction crossing the carrying direction. The rear end portion of the rear side conveyor means of the end sealing unit E is shown in FIG. 6.

As shown in FIG. 6, the rear side conveyor means of the end sealing unit E is composed of an upper holding conveyor belt 50 and a lower holding conveyor belt 51 which are opposed to each other with a central portion of each dry cell "a" put therebetween. A fourth small pulley 50*a* disposed at the rear end portion of the upper holding conveyor belt 50 in proximity to the upper surface of the carrying path of the dry cell groups is positioned in proximity to the rear side of the second small pulley 45*a* and the front side of the first small pulley 42. With this arrangement of the pulleys, the dry cell groups carried in the state being enclosed in the cylindrical film are certainly transferred from between the upper and lower holding conveyor belts 33 and 35 to between the upper and lower holding conveyor belts 50 and 51 disposed behind the end sealing unit E while being temporarily held on both sides of these conveyor belts 33, 35, 50 and 51 by the upper holding conveyor belts 40*a* and 40*b* and the lower holding conveyor belts 41*a* and 41*b*. Accordingly, in such transfer, the dry cell groups in the cylindrical film are prevented from getting out of shape.

In this way, the holding conveyor belts 50 and 51 disposed behind the end sealing unit E carry the dry cell groups enclosed in the cylindrical packaging film to the upper and lower end sealers 52 and 53 while holding them from above and below at the central portion of the carrying path.

Figure 7:
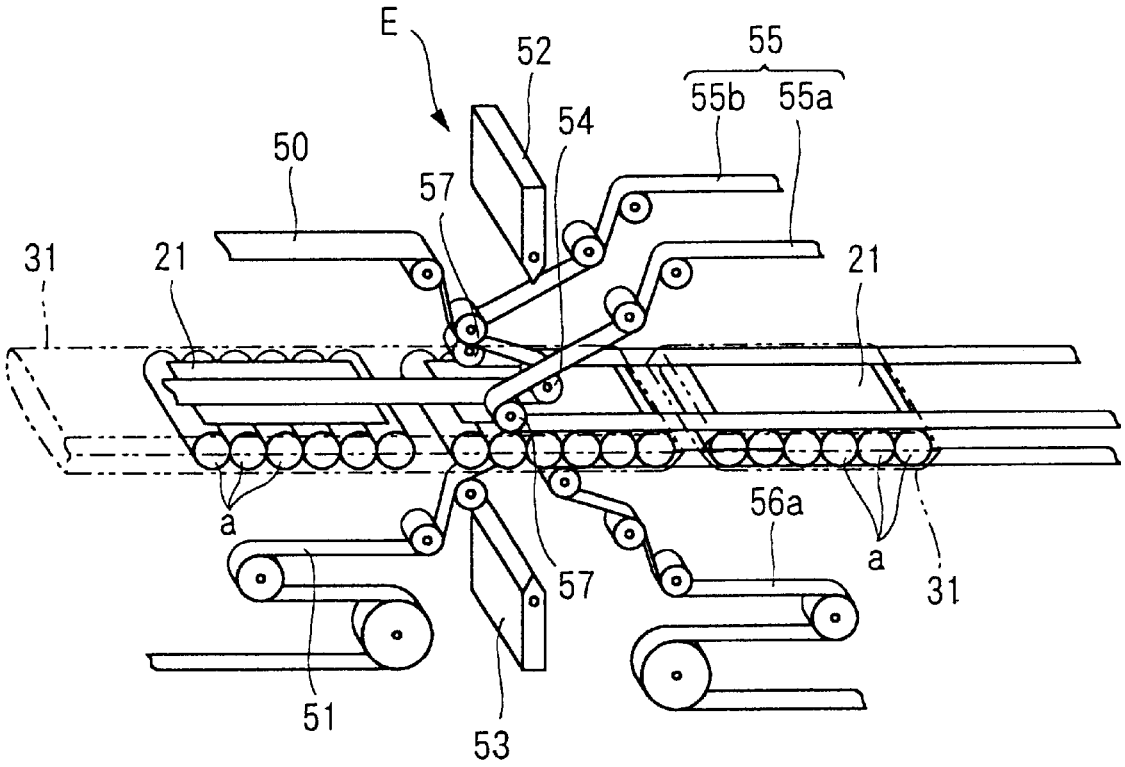
FIG. 7 is a perspective view showing a carrying conveyor belt portion when end sealers of the end sealing unit of the present invention are largely separated from each other in the vertical direction.

The front portions of the upper and lower holding conveyor belts 50 and 51 extend forwardly while horizontally pressing the cylindrical film enclosing the dry cell groups, and as shown in FIG. 7, the front ends of the front portions of the upper and lower holding conveyor belts 50 and 51 are wound around small pulleys 54 disposed in proximity to the central portion of the upper surface of the carrying path for the dry cell groups to be acutely set back rearwardly at an angle of about 30°.

On the other hand, the front side conveyor means disposed in front of the end sealing unit E is composed of upper and lower conveyor belts 55*a*, 55*b* and 56*a*, 56*b* each of which is formed of an endless belt having a relatively narrow width. To be more specific, the width of each of the upper and lower conveyor belts 55*a*, 55*b* and 56*a*, 56*b* is set to be narrower than that of each of the upper and lower holding conveyor belts 50 and 51 of the rear side conveyor means disposed at the central portion of the carrying path. The rear ends of the holding conveyor belts 55 and 56 each having a narrow width are wound around small pulleys 57 disposed in proximity to the upper surface of the carrying path for the dry cell groups and extend forwardly while horizontally pressing the cylindrical film enclosing the dry cell groups; and the upwardly and downwardly extending portions of the holding conveyor belts 55 and 56, respectively, are tilted forwardly at an acute angle of about 30° with respect to the horizontal plane. In addition, each of the front side conveyor means and the rear side conveyor means disposed in front of and behind the end sealing unit E, respectively, is driven at a speed equal to the carrying speed of the packaging film.

The upper and lower holding conveyor belts 50 and 51 constituting the rear side conveyor means disposed behind the end sealing unit E, which belts are disposed at the central portion of the carrying path, and the upper and lower holding conveyor belts 55*a*, 55*b* and 56*a*, 56*b* constituting the front side conveyor means disposed in front of the end sealing unit E, which belts are respectively disposed on the right and left sides of the carrying path, are moved forwardly and rearwardly in synchronization with the vertical movement of the upper and lower end sealers 52 and 53 for thermally fusing and cutting from above and below the cylindrical packaging film enclosing the dry cell groups.

By relatively moving forwardly and rearwardly the front side conveyor means and the rear side conveyor means disposed in front of and behind the end sealing unit E in synchronization with the vertical movement of the end sealers 52 and 53, the front side conveyor means and the rear side conveyor means can be disposed in proximity to each other when the end sealers 52 and 53 are separated from each other, and can be relatively separated from each other by a gap enough for the upper and lower end sealers 52 and 53 to hold the packaging film therebetween when the end sealers 52 and 53 are moved closer to each other. Such a structure will be described in detail later.

In a known structure, each of the front side conveyor means and the rear side conveyor means disposed in front of and behind the end sealers, respectively, is formed of a conveyor belt having a wide width, and the rear end of the front side conveyor means and the front end of the rear side conveyor belt are wound around pulleys disposed on a front and rear positional basis.

Figure 9:
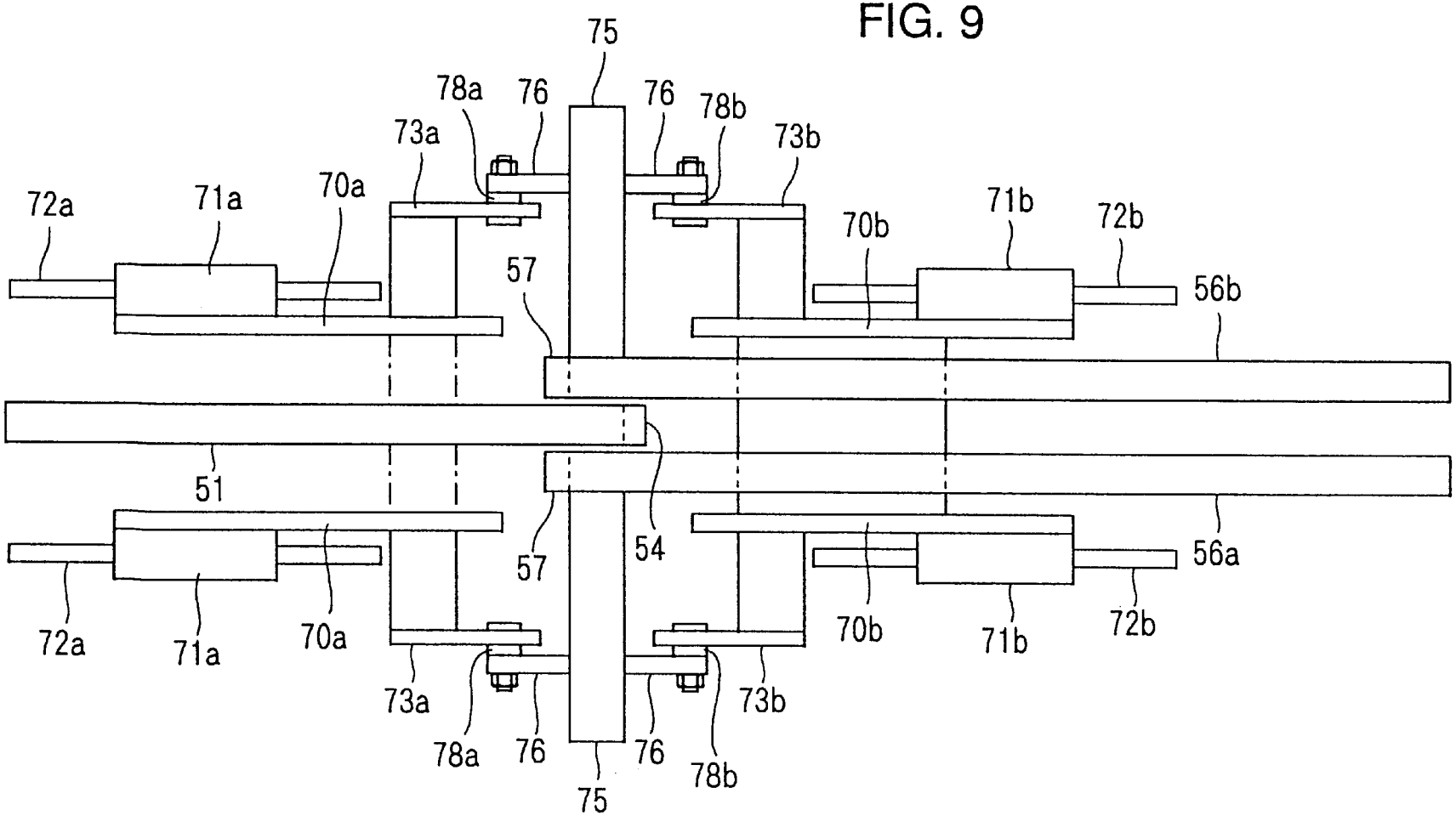
FIG. 9 is a plan view showing a front side carrying conveyor means and the rear side carrying conveyor means disposed in front of and behind the upper and lower end sealers of the present invention.

On the contrary, according to the present invention, when the upper and lower end sealers 52 and 53 are most separated from each other, as shown in FIGS. 7 and 9, the upper and lower holding conveyor belts 50 and 51 constituting the rear side conveyor means, which belts are disposed at the central portion of the carrying path, are respectively inserted between the upper and lower holding conveyor belts 55*a*, 55*b* and 56*a*, 56*b* constituting the front side conveyor means, which belts are disposed on the right and left sides of the carrying path. That is to say, in the above state, the small pulleys 54 of the rear side conveyor means 50 and 51 are positioned on the upstream side from the small pulleys 57 of the front side conveyor means 55*a*, 55*b* and 56*a*, 56*b* in the carrying direction. Accordingly, the dry cell groups enclosed in the cylindrical film are carried from the rear side conveyor means to the front side conveyor means in a state being stably kept in shape while being held by both the rear side conveyor means and the front side conveyor means.

Figure 8:
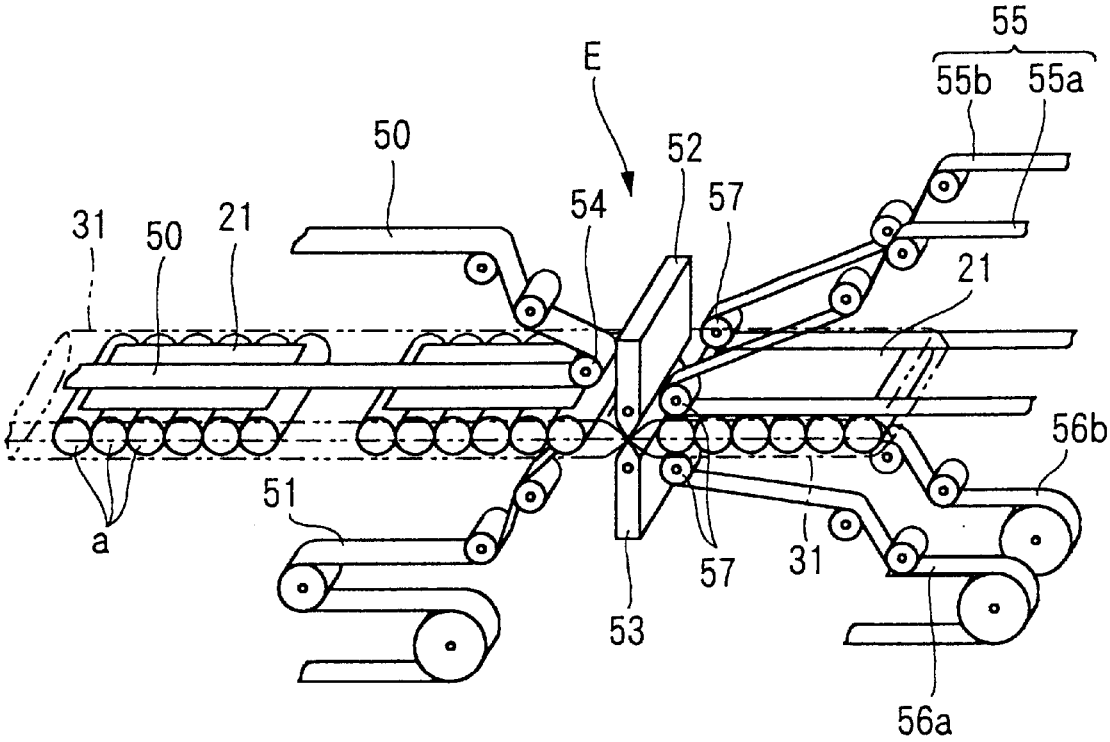
FIG. 8 is a perspective view showing the carrying conveyor belt portion when the end sealers of the end sealing unit of the present invention are moved closer to each other.

As the upper and lower end sealers 52 and 53 gradually come closer to each other, the front conveyor means 55 and 56 and the rear side conveyor means 50 and 51 are gradually moved in the direction in which they are separated from each other, respectively. When the upper and lower end sealers 52 and 53 hold a boundary between a film portion enclosing one cell group and a film portion enclosing the next cell group, as shown in FIG. 8, the front side conveyor means 55 and 56 are separated from the rear side conveyor means 50 and 51, respectively. After that, as the upper and lower end sealers 52 and 53 are separated from each other, the front side conveyor means and the rear side conveyor means come closer to each other into the state shown in FIG. 7.

Hereinafter, the mechanism in which the front side conveyor means 55 and 56 and the rear side conveyor means 50 and 51 are moved apart from or close to each other when the upper and lower end sealers 52 and 53 are moved close to or apart from each other will be described with reference to FIGS. 9 and 10*a*, 10*b*.

FIG. 9 is a plan view showing only the lower holding conveyor belts 51 and 56 of the rear side conveyor means and the front side conveyor means. The holding conveyor belt 51 of the rear side conveyor means is mounted on rear side conveyor frames 70*a*, and the holding conveyor belts 56*a* and 56*b* of the front side conveyor means are mounted on front side conveyor frames 70*b* separated from the rear side conveyor frames 70*a*. Sliders 71*a* and 71*b* are mounted on the conveyor frames 70*a* and 70*b*, respectively. The sliders 71*a* and 71*b* are slidably inserted around slide guides 72*a* and 72*b* fixed on the bases, respectively.

Figure 10A:
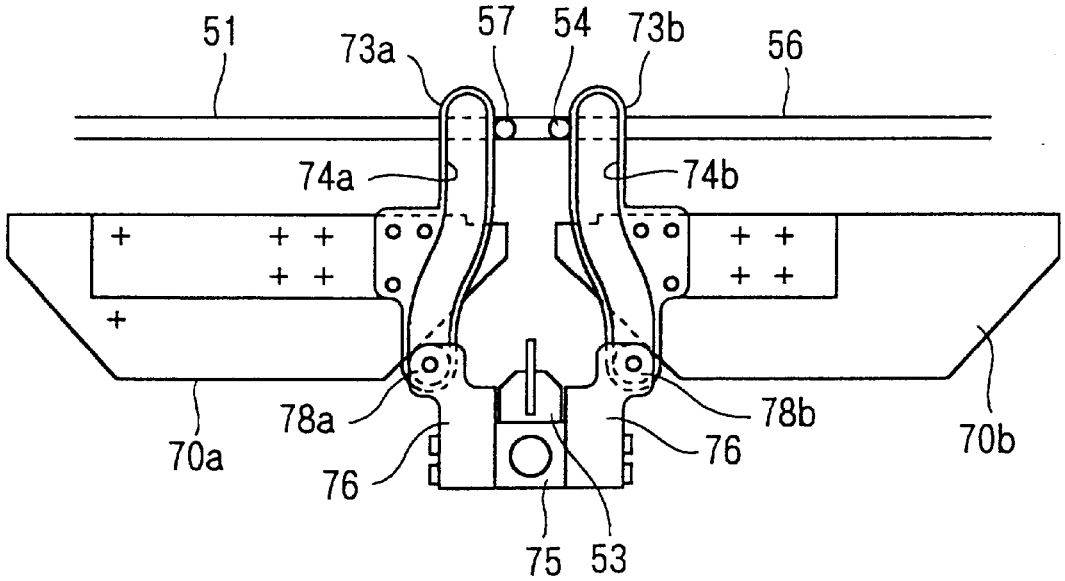
Figure 10B:
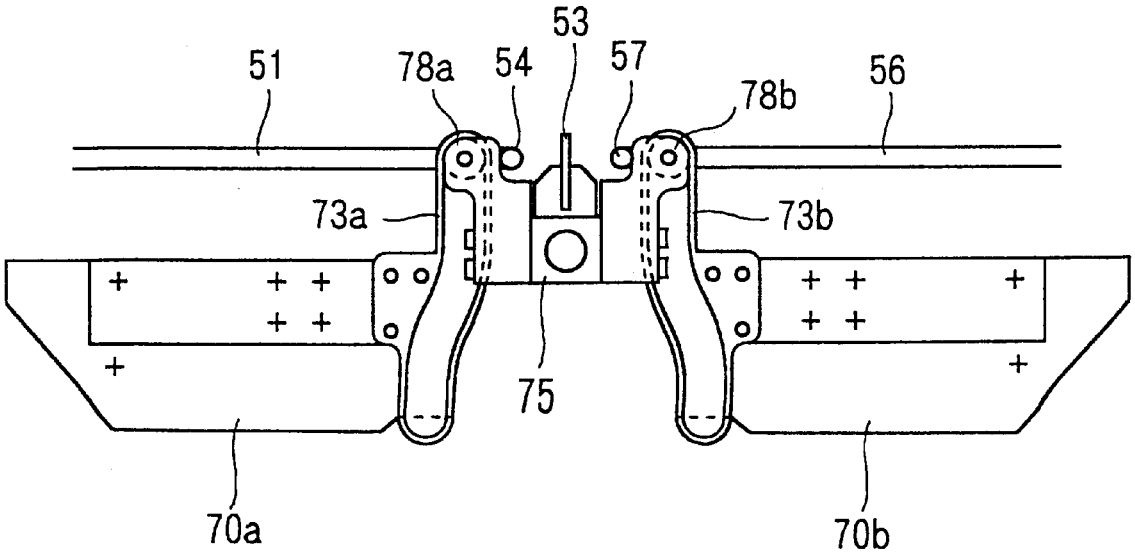

Guide cams 73*a* and 73*b*, as shown in FIGS. 10*a* and 10*b*, are fixed on end portions, disposed in proximity to each other, of the conveyor frames 70*a* and 70*b*, respectively. The upper ends of the guide cams 73*a* and 73*b* are disposed in proximity to each other, and the lower ends thereof are disposed in such a meandering manner as to be separated to each other. Cam grooves 74*a* and 74*b* are formed in the guide cams 73*a* and 73*b*, respectively. An end sealer mounting block 75 is disposed between the rear side guide cam 73*a* and-the front side guide cam 73*b*. The lower end sealer 53 is fixed at a central portion of the upper surface of the mounting block 75 and cam followers 78*a* and 78*b* are mounted on both sides of the mounting block 75 via mounting pieces 76. These cam followers 78*a* and 78*b* are loosely fitted in the cam grooves 74*a* and 74*b* formed in the guide cams 73*a* and 73*b*, respectively.

The end sealer mounting block 75 has a known mechanism in which it is loosely fitted in an annular cam groove (not shown) fixed on a base via an eccentrically rotatable eccentric cam follower (not shown) in order to convert the rotational motion of the eccentric cam follower along the annular cam groove into the vertical motion of the end sealer. Similarly, an upper end sealer mounting block (not shown) is loosely fitted in an annular cam groove fixed on a base via an eccentric cam follower in order to convert the rotational motion of the eccentric cam follower along the annular cam groove into the vertical motion of the end sealer. By the synchronized rotation of the eccentric cam followers, the upper and lower end sealers 52 and 53 are moved closer to or apart from each other. In this way, when moved closer to each other, the upper and lower end sealers 52 and 53 fuse and cut a packaging film portion positioned therebetween.

With this configuration, as shown in FIGS. 9 and 10*a* when the upper and lower end sealers 52 and 53 are most separated from each other, the smaller pulleys 57 at the rear ends of the front side conveyor means 55 and 56 are positioned behind the small pulleys 54 at the front ends of the rear side conveyor means 50 and 51, so that the front end portions of the rear side conveyor belts 50 and 51 positioned at the central portion of the dry cell groups to be packaged are inserted between the front side conveyor belts 55*a*, 55*b* and 56*a*, 56*b* positioned on the right and left sides of the dry cell groups to be packaged, respectively. In such a state, the dry cell groups to be packaged are certainly carried from the rear side conveyor means to the front side conveyor means in such a manner that the central portions and both side portions of the dry cell groups are simultaneously held by the front side conveyor means and the rear side conveyor means.

Next, as the upper and lower end sealers 52 and 53 are moved close to each other from the positions shown in FIG. 10*a* the upper and lower end sealer mounting blocks 75 are moved downwardly and upwardly, respectively. As a result, the guide cams 73*a* and 73*b* are biased in the direction in which they are separated from each other, and the conveyor frames 70*a* and 70*b* mounted to the guide cams 73*a* and 73*b* are separated from each other by sliding motion of the sliders 71*a* and 71*b* along the slide guides 72*a*and 72*b*, respectively. The rear side conveyor means 50 and 51 and the front side conveyor means 55 and 56 mounted to the conveyors frames 70*a* and 70*b* are thus moved in the direction in which they are separated from each other, respectively, so that the small pulleys 57 at the rear ends of the front side conveyor means 55 and 56 are gradually moved in the direction in which they are separated from the small pulleys 54 at the front ends of the rear side conveyor means 50 and 51.

When the lower end sealer mounting block 75 reaches the uppermost end in FIG. 10*b*, the small pulley 57 at the rear end of the front side conveyor means 56 is separated forwardly from the small pulley 54 at the front end of the rear side conveyor means 51 to form a space between both the conveyor means. At this time, the upper and lower end sealers 52 and 53 are closest to each other, and as shown in FIG. 8, they hold from above and below a boundary between a film portion enclosing one cell group and a film portion enclosing the next cell group, and fuse and cut the boundary portion, to thus perform end sealing. After that, the lower end sealer mounting block 75 shown in FIG. 10*b* is moved down to the state shown in FIG. 10*a*, and the front side conveyor means and the rear side conveyor means are gradually returned to the state shown in FIG. 7. The above-described operation is then repeated.

Each dry cell package 58 obtained by heat-sealing and cutting a boundary between a cylindrical film portion enclosing one cell group and a cylindrical film portion enclosing the next cell group by the end sealers 52 and 53 is carried to a net conveyor F with a shrink tunnel 60 provided on its upper side by the front side conveyor means 55 and 56.

The front end portion of the lower holding conveyor belt 56 of the front side conveyor means is configured to be movable forwardly and rearwardly in order to drop a defective package at a position being in proximity to and on the downstream side from the net conveyor F for separating the defective package from non-defective packages.

Figure 11:
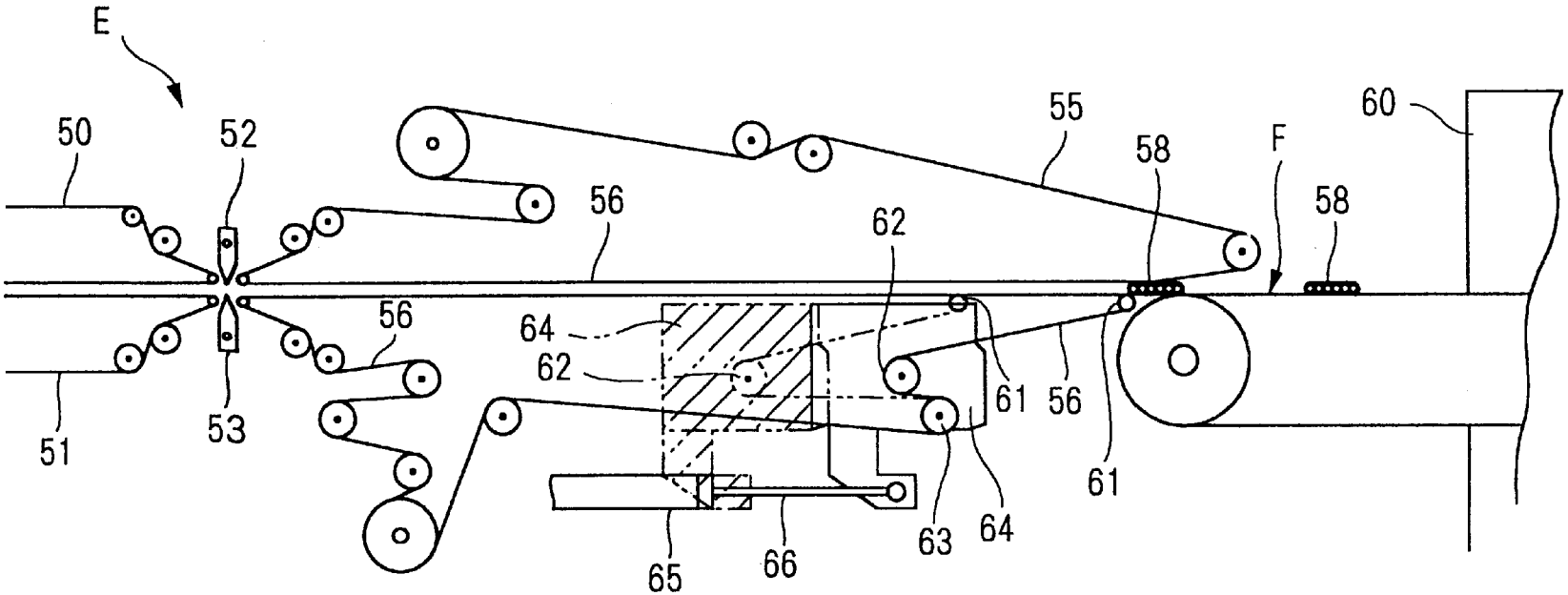
FIG. 11 is a schematic view showing a relative positional relationship between a front side belt conveyor disposed in front of the end sealing unit and a net conveyor including a shrink tunnel according to the present invention.

To be more specific, as shown in FIG. 11, the front end of a portion, extending forwardly in the horizontal direction, of the lower holding conveyor belt 56 is wound around a small pulley 61 to be turned back, being wound in an S-shape around a movable pulley 62 on the rear lower side seen from the small pulley 61 and around a fixed pulley 63 on the front lower side seen from the movable pulley 62, and extends rearwardly therefrom. The small pulley 61 and the movable pulley 62 are mounted on a sliding block 64 which is supported in such a manner as to be slidably moved forwardly and rearwardly. The sliding block 64 is joined to the leading end of a piston rod 66 of an air cylinder 65 fixed on a frame. When the piston rod 66 is extended, the sliding block 64 is slid such that the small pulley 61 is located at the forefront being in proximity to the net conveyor F as shown by a solid line in FIG. 11. When the piston rod 66 is contracted, the sliding block 64 is slid such that the small pulley 61 is retreated from the forefront by a distance equivalent to the length of the dry cell package 58 as shown by a chain line in FIG. 11, whereby a defective dry cell package having been carried on the lower holding conveyor belt 56 is dropped at a position being in front of and on the downstream side from the net conveyor F to be thus ejected. The air cylinder 65 is driven on the basis of a known defective package detecting signal. Accordingly, only non-defective dry cell packages 58 are carried on the net conveyor F, and when each dry cell package 58 passes through the shrink tunnel 60, the packaging film is thermally shrunk to be brought into tight-contact with the dry cell group of the package 58. In this way, desired dry cell packages are obtained.

What is claimed is:

1. A method of packaging groups of cylindrical articles, comprising the steps of:

carrying cylindrical articles forwardly while sorting said articles into groups, each group being composed of a predetermined number of said articles;

inserting said article groups in a thermal shrinkage film formed into a cylindrical shape;

heat-sealing, in the course of carrying said article groups enclosed in said film, a boundary between one film portion enclosing one of said article groups and a film portion enclosing the next of said article groups by upper and lower end sealers;

wherein said step of heat-sealing said film comprises the steps of:

preparing front side and rear side holding conveyor belts for pressing from above said articles, which conveyor belts are provided on front side and rear side carrying conveyor means disposed in front of and behind said upper and lower end sealers respectively, wherein at least one of said holding conveyor belts is movable forwardly and rearwardly relative to the other;

positioning a rear end of said front side holding conveyor belt behind a front end of said rear holding conveyor belt in a state in which said upper and lower end sealers are most separated from each other; and moving at least one of said holding conveyor belts so as to be separated from each other as said upper and lower end sealers are gradually moved closer to each other.

2. A method of packaging groups of cylindrical articles according to claim 1, wherein said cylindrical articles are dry cells.

3. A method of packaging groups of cylindrical articles according to claim 1, further comprising the step of thermally shrinking only portions of said thermal shrinkage film enclosing said articles, which face to end surfaces of said articles, before said step of heat-sealing a portion of said film by said upper and lower end sealers.

4. A method of packaging groups of cylindrical articles according to claim 1, wherein said step of carrying and sorting said articles comprises the step of: carrying said articles along a carrying path at a predetermined speed while sorting said articles into said groups by means of a number of guide pins which are capable of protrusion into and retreat from the articles in the direction perpendicular to the carrying path and which are moved at a speed equal to the carrying speed of said articles; and said step of inserting said article groups in said film includes step of inserting said guide pins together with said articles in a film which is formed into a cylindrical shape with its side portion on said guide pin side opened and carried at a speed equal to the carrying speed, and then pulling said guide pins out of said film.

5. A method of packaging groups of cylindrical articles according to claim 3, further comprising the step of:

feeding a sheet material on the upper surfaces of each of said article groups, and carrying said sheet materials together with said article groups in said film, in the course of carrying said article groups along with carrying path while holding said article groups with said guide pins.

6. A method of packaging groups of cylindrical articles according to claim 5, wherein said sheet material is pasteboard.

* * * * *